United States Patent [19]

Hair, II

[11] Patent Number: 4,854,448

[45] Date of Patent: Aug. 8, 1989

[54] CHILD PROOF CONTAINER

[75] Inventor: John Hair, II, Walla Walla, Wash.

[73] Assignee: Child Safety Products, Walla Walla, Wash.

[21] Appl. No.: 185,886

[22] Filed: Apr. 25, 1988

[51] Int. Cl.[4] ..... B65D 55/02

[52] U.S. Cl. ..... 206/1.5; 70/63; 220/326; 292/DIG. 65

[58] Field of Search ..... 70/63, 69; 206/1.5; 220/324, 326; 292/102, 203, DIG. 65

[56] References Cited

U.S. PATENT DOCUMENTS

| | | | |
|---|---|---|---|
| 1,152,404 | 9/1915 | Emmers | 292/DIG. 65 |
| 2,233,699 | 10/1940 | Gorrell | 292/DIG. 65 |
| 2,759,782 | 2/1953 | Goodwin, Jr. | 292/1 |
| 2,936,189 | 5/1960 | Pearson | 206/1.5 |
| 3,109,900 | 11/1963 | Van Hook | 206/1.5 |
| 3,115,269 | 12/1963 | Rasmussen | 220/326 |
| 3,608,341 | 9/1971 | Galtz | 70/95 |
| 3,666,338 | 5/1972 | Russell | 312/218 |

*Primary Examiner*—Jimmy G. Foster
*Attorney, Agent, or Firm*—Eugene D. Farley

[57] ABSTRACT

A child proof container for storing dangerous articles such as medicines, poisons, hand guns, knives and the like. The container comprises wall structure defining a receptacle and an access opening. A closure provided with a finger hole is mounted across the opening. Finger operated latch means interconnect the closure member and the wall structure. The latch means is positioned apart from the finger hole a spaced distance predetermined to prevent latch operation by short fingered individuals.

A combination finger guide and baffle is mounted on the closure member for guiding the finger into latching engagement and also for shielding the receptacle contents from finger contact. A mounting for the latch mounts the latter adjustably in selected positions toward or away from the finger hole as required to adjust the spaced distance therebetween to the finger length of the operator.

5 Claims, 1 Drawing Sheet

FIG. 1
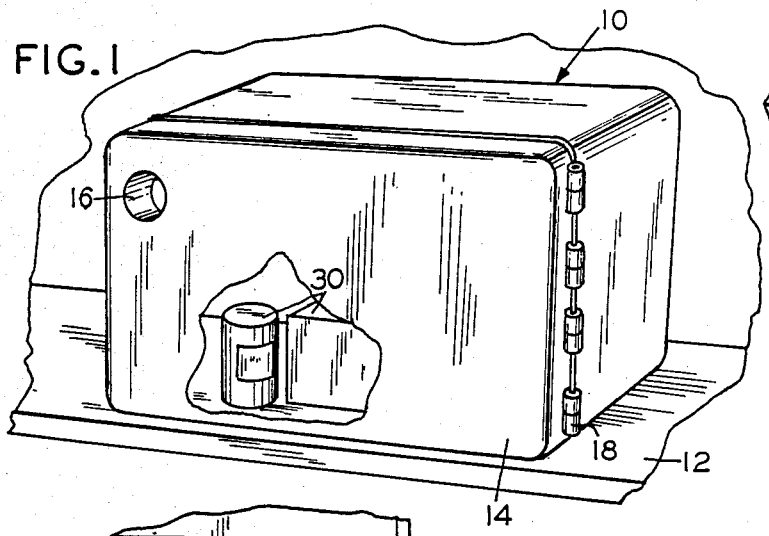
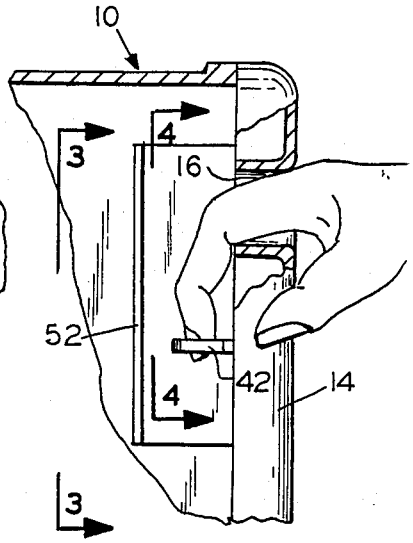
FIG. 2
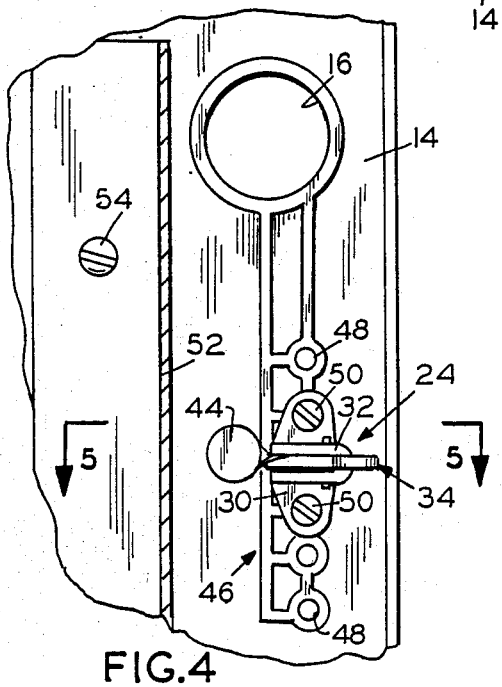
FIG. 4
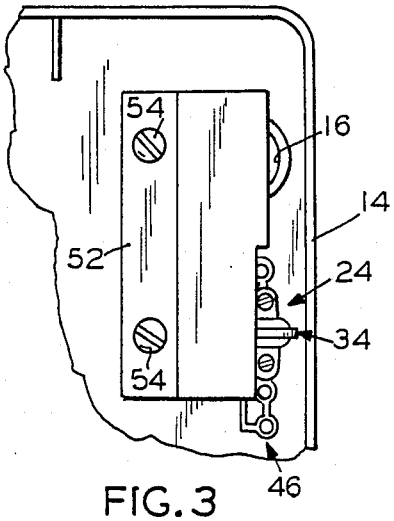
FIG. 3
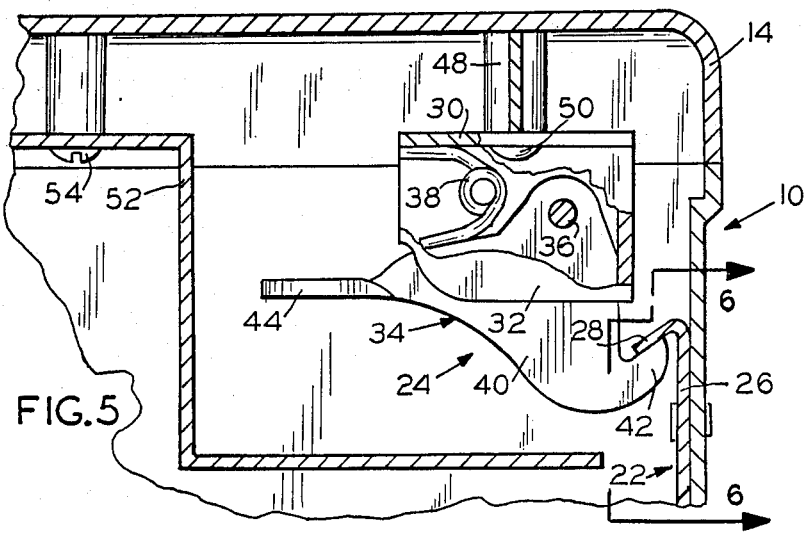
FIG. 5
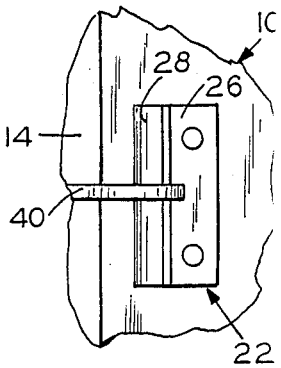
FIG. 6

CHILD PROOF CONTAINER

BACKGROUND AND GENERAL STATEMENT OF THE INVENTION

This invention pertains to child proof containers. It pertains particularly to storage containers for use in keeping safe from the prying fingers of small children harmful articles such as medicines, poisons, cutlery and handguns.

It is the general purpose of the present invention to provide a child proof container which is simple in construction, easily and effectively used, and adapted for use in either stationary or portable installations.

It is a particular object of the present invention to provide a child-proof container provided with latching means which are adjustable in mounting position to accommodate the finger length of the operator.

It is another important object of the present invention to provide a child proof container provided with finger-operated latching means including a protective latch guideway.

Generally stated, the child proof container achieving the foregoing and other objects of this invention comprises wall structure defining a receptacle and an access opening. A closure member having a finger hole is configured and dimensioned for mounting across the opening.

A finger-operated latch releasably latches the closure to the wall structure. The latch is positioned apart from the finger hole a spaced distance predetermined to prevent latch operation by short-fingered individuals.

The latch includes a latch mounting for mounting the latch in selected position toward and away from the finger hole, thereby adjusting the spaced distance between the latch and the finger hole to suit the finger length of the operator.

A combination finger guide and shield is mounted on the closure member for guiding the finger into latch engagement and also for shielding the receptacle contents from finger contact.

THE DRAWINGS

In the drawings:

FIG. 1 is a top perspective view of the child proof container of the invention.

FIG. 2 is a fragmentary broken away view, partly in section, illustrating the latching mechanism and the manner of operating the same.

FIG. 3 is a fragmentary view in elevation looking in the direction of the arrows of line 3—3 of FIG. 2.

FIG. 4 is a fragmentary sectional view taken along lines 4—4 of FIG. 2, illustrating particularly the latch striker mechanism.

FIG. 5 is a sectional fragmentary view of the latching mechanism taken along line 5—5 of FIG. 4; and FIG. 6 is a fragmentary view in elevation taken along line 6—6 of FIG. 5, illustrating particularly the latch keeper mechanism.

DESCRIPTION OF A SPECIFIC EMBODIMENT OF THE INVENTION

The child proof container of the invention may comprise a receptacle designed either for portability or for affixation to a wall, shelf or other structure. It also may comprise the drawer of a chest of drawers.

As illustrated in FIG. 1, it comprises a freestanding, portable receptacle indicated generally at 10 and resting on shelf 12. If it is desired to use the container in a fixed condition, it may be drilled and fixed by means of screws or other fasteners to a shelf, wall, or other structural member.

The container comprises wall structure defining an access opening across which is mounted a suitable closure member, i.e. door 14 provided with finger hole 16. The door is hinged to the receptacle by means of hinges 18.

The receptacle is sized and dimensioned to contain desired articles, for example medicines and/or poisons, indicated at 20. It also may be dimensioned to contain other dangerous articles such as hand guns, cutlery, and the like.

Latching means are provided for releasably latching door 14 in its closed position. As illustrated in FIG. 2, the latch means is positioned apart from finger hole 16 a spaced distance predetermined to prevent latch operation by short-fingered individuals, i.e. by children.

The latch means employed comprises a keeper, or retainer indicated generally at 22 and a striker indicated generally at 24.

As illustrated in FIGS. 5 and 6, keeper 22 comprises a strip of metal, plastic or other structural material reversely bent to provide a base segment 26 and an inwardly extending latching segment 28. The keeper is mounted a spaced distance from finger opening 16 and extends an appreciable distance along the side wall of the container toward and away from the finger opening. It is affixed to the side wall by suitable means, for example by means of rivets 29.

Latch striker 24 preferably comprises a "rocker" type latch striker. It comprises a base plate 30, a housing 32 extending at right angles thereto, a striker piece 34 pivotally mounted in the housing by pivot pin 36, and a spring 38 normally biasing the striker piece in the direction of latch closure.

Striker piece 34 comprises a body segment 40, a latching segment 42, and a lever-shaped operating segment 44. Latching segment 42 is dimensioned and configured to engage flange 28 of keeper 22 in any position along the length of the latter, as illustrated in FIGS. 5 and 6.

Mounting means are provided for mounting latch striker assembly 24 in various positions of adjustment toward and away from finger opening 16, as required to adjust the distance to suit the finger length of the operator. In general, this distance should be within the finger reach of the operator, but beyond the finger reaching capability of small children. The structure accomplishing this purpose is illustrated particularly in FIGS. 3 and 4.

The striker assembly mounting base 46 comprises a plurality of spaced apart screw seats 48 arranged in a row in a direction away from finger hole 16 but parallel to and spaced from keeper flange 28 and within operating range thereof. The latch striker assembly then is releasably mounted in the desired position on striker mounting base 46 by means of mounting screws 50 inserted in a selected pair of the screw mounting seats 48. When thus mounted in any of the screw mounting seats, latching member 42 is within operating distance of the associated keeper.

Means also are provided for guiding the operator's finger into operative engagement with operating lever 44, and for protecting the finger from contact with harmful objects stored within the receptacle, for example knife or scissor blades.

To this end there is provided a combination shield and guide plate 52. This member of the assembly comprises an angularly bent sheet of plastic or metal affixed to the door 14 by means of screws 54 and covering and shielding the latching area.

The manner of use of the herein described child proof container is illustrated particularly in FIG. 2.

Insertion of the operator's finger through finger hole 16 and into the combination guide and shield 52 enables the operator to reach operating lever 44 and to release the striker element 42 from keeper flange 28 without contacting the contents of the receptacle. If the distance between finger hole 16 and the latch lever 44 is either too great or too small for the desired purpose, it may be adjusted as necessary by releasing mounting screws 50 and re-attaching striker assembly 24 in the appropriate ones of seats 48.

Having thus described in detail a preferred embodiment of the present invention, it will be apparent to those skilled in the art that various physical changes could be made in the device described herein without altering the inventive concepts and principles embodied. The present embodiment is thus to be considered in all respects as illustrative and not restrictive, the scope of the invention being indicated by the appended claims.

We claim.

1. A child proof container comprising:

(a) wall structure defining a receptacle and an access opening, (b) a closure member for the receptacle configured and dimensioned for mounting across the opening, (c) a finger-entry opening in the closure member, and (d) finger operated latch means latchably interconnecting the closure member and the wall structure, (e) the latch means being positioned apart from the opening by a spaced distance predetermined to prevent latch operation by individuals with short fingers, (f) the latch means comprising a striker and a keeper, and mounting means for mounting one of them adjustably in a selected position toward or away from the opening as required to adjust the spaced distance therebetween to the finger length of the authorized operator.

2. The child proof container of claim 1 wherein the latch means comprises a keeper mounted on the wall structure adjacent the closure member, a striker base mounted on the closure member adjacent the keeper, a striker, and mounting means on the striker for mounting it on the striker base in a selected position toward or away from the opening.

3. The child proof container of claim 2 wherein the mounting means comprises threaded interengaging means.

4. The child proof container of claim 2 wherein the striker comprises a pivotally mounted, spring biased, rocker-type striker.

5. The child proof container of claim 2 wherein the striker base comprises a plurality of aligned screw seats, the striker comprises a pivotally mounted, spring biased, rocker-type striker, and the mounting means comprises screw means engaging selected ones of the aligned screw seats.

* * * * *